US009960489B2

(12) United States Patent
Kim et al.

(10) Patent No.: US 9,960,489 B2
(45) Date of Patent: May 1, 2018

(54) ELECTRONIC DEVICE AND METHOD OF OPERATING THE SAME

(71) Applicant: Samsung Electronics Co., Ltd., Suwon-si, Gyeonggi-do (KR)

(72) Inventors: Kyung-Gu Kim, Suwon-si (KR); Gyu-Sub Kim, Suwon-si (KR); Young Heo, Suwon-si (KR); Se-Hyun Park, Suwon-si (KR); Jin-Woo Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 183 days.

(21) Appl. No.: 14/466,511

(22) Filed: Aug. 22, 2014

(65) Prior Publication Data

US 2015/0054701 A1 Feb. 26, 2015

(30) Foreign Application Priority Data

Aug. 23, 2013 (KR) ..... 10-2013-0100528
Jun. 25, 2014 (KR) ..... 10-2014-0078030

(51) Int. Cl.

| | |
|---|---|
| ***H01Q 5/364*** | (2015.01) |
| ***H01Q 5/321*** | (2015.01) |
| ***H01Q 5/378*** | (2015.01) |
| ***H01Q 9/42*** | (2006.01) |

(Continued)

(52) U.S. Cl.

CPC ..... *H01Q 5/364* (2015.01); *H01Q 5/321* (2015.01); *H01Q 5/378* (2015.01); *H01Q 9/0442* (2013.01); *H01Q 9/145* (2013.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 7,321,335 | B2 * | 1/2008 | Egorov | H01Q 1/243 343/700 MS |
| 8,638,266 | B2 * | 1/2014 | Liu | H01Q 9/0421 343/767 |
| 2004/0041734 | A1 | 3/2004 | Shiotsu et al. | |

(Continued)

FOREIGN PATENT DOCUMENTS

| | | | |
|---|---|---|---|
| EP | 2 645 479 | A1 | 10/2013 |
| JP | 2011-015034 | * | 1/2011 |

(Continued)

OTHER PUBLICATIONS

Chinese Office Action dated Jun. 2, 2017, issued in the Chinese Application No. 201480046495.X.

*Primary Examiner* — Robert Karacsony
(74) *Attorney, Agent, or Firm* — Jefferson IP Law, LLP

(57) ABSTRACT

An electronic device including a processor and an antenna device is provided. The antenna device includes a power feeding unit, a first radiation section connected to the power feeding unit, and a switching element including a first terminal electrically connected to first portion of the first radiation section, and a second terminal electrically connected to a second portion of the first radiation section. The processor uses a first resonance frequency band when the switching element is opened and uses a second resonance frequency which is different from the first when the switching element is closed.

8 Claims, 9 Drawing Sheets

(51) Int. Cl.
*H01Q 9/14* (2006.01)
*H01Q 9/04* (2006.01)

(56) References Cited

U.S. PATENT DOCUMENTS

| | | | | |
|---|---|---|---|---|
| 2009/0167617 | A1* | 7/2009 | Nishio | H01Q 9/0421 343/702 |
| 2012/0287014 | A1* | 11/2012 | Tseng | H01Q 1/243 343/876 |
| 2013/0050026 | A1 | 2/2013 | Vin et al. | |
| 2013/0099996 | A1 | 4/2013 | Tseng et al. | |
| 2013/0257679 | A1* | 10/2013 | Wong | H01Q 9/42 343/876 |
| 2014/0015729 | A1* | 1/2014 | Uejima | H01Q 9/14 343/850 |
| 2014/0145892 | A1* | 5/2014 | Tseng | H01Q 5/321 343/750 |

FOREIGN PATENT DOCUMENTS

| | | | |
|---|---|---|---|
| JP | 2011-015034 | A | 1/2011 |
| JP | 2012-160817 | A | 8/2012 |
| JP | 5321290 | B2 | 10/2013 |
| KR | 10-2011-0068246 | A | 6/2011 |
| KR | 10-1209621 | B1 | 12/2012 |
| KR | 10-2013-0020981 | A | 3/2013 |
| WO | 2012/157314 | A1 | 11/2012 |
| WO | 2012/169186 | A1 | 12/2012 |

* cited by examiner

ELECTRONIC DEVICE AND METHOD OF OPERATING THE SAME

CROSS-REFERENCE TO RELATED APPLICATION(S)

This application claims the benefit under 35 U.S.C. § 119(a) of a Korean patent application filed on Aug. 23, 2013 in the Korean Intellectual Property Office and assigned Serial No. 10-2013-0100528, and of a Korean patent application filed on Jun. 25, 2014 in the Korean Intellectual Property Office and assigned Serial No. 10-2014-0078030, the entire disclosure of each of which is hereby incorporated by reference.

TECHNICAL FIELD

The present disclosure relates to an electronic device. More particularly, the present disclosure relates to an antenna device that transmits/receives radio signals and an electronic device with the same.

BACKGROUND

Typically, an electronic device refers to a device that executes a specific function according to a program installed therein, for example, a digital organizer, a portable multimedia player, a mobile communication terminal, a tablet Personal Computer (PC), an image/sound device, a desktop/laptop computer, a vehicle navigation system, a home appliance, and the like. Such electronic devices may output information stored therein as a sound or an image. Recently, various functions have been incorporated in a single mobile communication terminal as the degree of integration of such an electronic device has been increased and high speed and high capacity wireless communication has become common. For example, an entertainment function such as a game, a multimedia function such as reproduction of a music/moving image, a communication and security function for mobile banking or the like, a scheduling function, an electronic wallet function, etc. are integrated into a single electronic device, in addition to a communication function. As multimedia service functions or entertainment functions using an electronic device such as a mobile communication terminal are strengthened, users tend to prefer an electronic device which is convenient to carry as well as provides a display device of a sufficient size.

An antenna device is provided in an electronic device in order to enable wireless communication. When the antenna device is installed to be sufficiently spaced away from other circuit devices, it is possible to suppress the interference of the antenna with the other circuit devices in the process of transmitting/receiving high frequency signals. An electronic device that executes ultra-high speed and high capacity radio communication, for example, an electronic device that complies with 4G mobile communication standards such as Long Term Evolution (LTE) communication standards may access commercial communication networks through various frequency bands. In order for a single electronic device to execute access various frequency bands, the electronic device includes an antenna device which may be provided with a plurality of radiators of which the number corresponds to the number of the frequency bands.

However, in the reality of providing a portable electronic device by reducing its thickness while providing a display device of a sufficient size, there are difficulties in installing an antenna device. For example, in the reality of reducing the thickness of an electronic device, there is a limit in increasing the number of radiators to correspond to the number of various radio communication frequency bands while suppressing interference with other circuit devices. Accordingly, there exists a need for an improved antenna radiator that is able to radiate different frequencies while suppressing interference with other circuits.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device capable of coping with various frequency bands with a simple structure and an electronic device having the same.

Another aspect of the present disclosure is to provide an antenna device which may be easily miniaturized while coping with various frequency bands and an electronic device having the same.

In accordance with an aspect of the present disclosure, an electronic device is provided. The electronic device includes a processor and an antenna device. The antenna device includes a power feeding unit, a first radiation section electrically connected to the power feeding unit, and a switching element including a first terminal electrically connected to a first portion of the first radiation section and a second terminal electrically connected to a second portion of the first radiation section. The processor may use a first resonance frequency by opening the switching element and use a second resonance frequency which is different from the first resonance frequency by closing the switching element.

In accordance with another aspect of the present disclosure, an electronic device is provided. The electronic device includes an antenna device that includes a first radiation section and a switching element that selectively opens/closes any one portion and at least one other portion of the first radiation section. A resonance frequency band of the antenna device may be adjusted depending on an opening/closing operation of the switching element.

In accordance with another aspect of the present disclosure, a method of operating an electronic device including an antenna device that includes a first radiation section, and a switching element including a first terminal electrically connected to a first portion of the first radiation section and a second terminal electrically connected to a second portion of the first radiation section is provided. The method includes using a first resonance frequency when the switching element is opened, and using a second resonance frequency which is different from the first resonance frequency when the switching element is closed.

In accordance with another aspect of the present disclosure, an antenna device is provided. The antenna device includes a switching element that adjusts an electrical length while maintaining a physical length of a radiation section so that a good radiation efficiency can be obtained in each of different frequency bands. According to various embodiments of the present disclosure, even when the switching element of the antenna device is switched ON, signal currents may be distributed in another portion of the radiation section which is arranged in parallel to the switching element so that a loss by a resistance component of the switching element can be reduced or prevented. In addition, according to various embodiments of the present disclosure, assuming that a resonance frequency in a low frequency band is adjusted depending on the ON/OFF operation of the switching element in the antenna device, a designed performance can be maintained in a resonance frequency in a high frequency band regardless of the ON/OFF operation of the switching element.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Terms used hereinafter are defined in consideration of functions in various embodiments of the present disclosure and may be replaced with other terms according to a user's or operator's intention or practice. Accordingly, the terms will be more clearly defined according to the descriptions of the various embodiments of the present disclosure. In addition, ordinal numbers such as "first" and "second" are merely used in describing the various embodiments of the present disclosure so as to differentiate objects of the same name from each other and may be optionally determined.

According to various embodiments of the present disclosure, an antenna device is provided with a switching element that adjusts a length of a radiation section connected to a power feeding unit. According to various embodiments of the present disclosure, the switching element may be arranged between any one portion and another portion in the radiation section to be capable of adjusting an electric length of the radiation section through an ON/OFF operation. When the electric length of the radiation section is adjusted, a resonance frequency band may be adjusted. In that event, because a signal current may be distributed between the one portion and the other portion of the radiation section even though the electric length of the radiation section may be adjusted by the switching element, the antenna device according to the various embodiments of the present disclosure may suppress a loss caused by the switching element.

Figure 1:
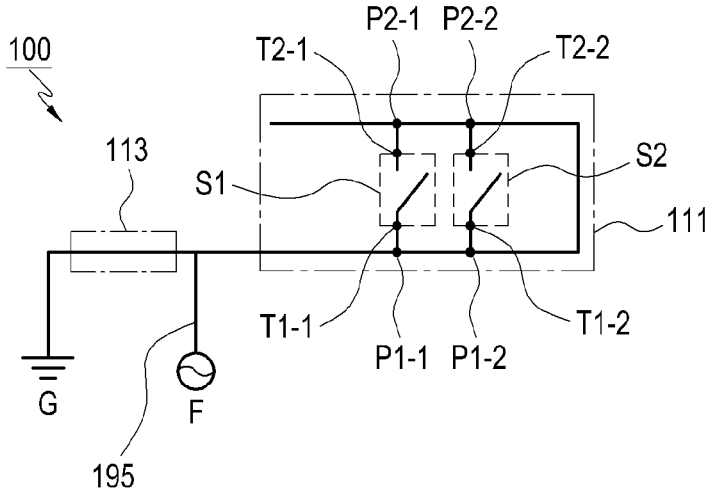
FIG. 1 is a schematic view illustrating an antenna device according to an embodiment of the present disclosure.

FIG. 1 is a schematic view illustrating an antenna device according to an embodiment of the present disclosure.

Referring to FIG. 1, an antenna device 100 according to one of various embodiments of the present disclosure may be provided with a first radiation section 111 and one or more switching elements S1 and S2.

The first radiation section 111 may be implemented in various forms such as a rod, a meander line, a patch, a micro-strip, and the like. Further, the first radiation section 111 may be configured to be capable of transmitting/receiving high frequency signals in at least one frequency band. The first radiation section 111 may be connected to a power feeding unit F through a power feeding line 195 so that a signal current may be applied to the first radiation section 111.

FIG. 1 exemplifies a configuration in which a pair of switching elements S1 and S2 are arranged in parallel to each other. Of the switching elements S1 and S2, the first switching element S1 is arranged between any one portion (hereinafter, a "first portion") P1-1 and another portion (hereinafter, a "second portion") P2-1 of the first radiation section 111 to be capable of performing an ON/OFF operation. The first switching element S1 may include a first terminal T1-1 electrically connected to the first portion P1-1, and a second terminal T2-1 electrically connected to the second portion P2-1. When the switching element S1 is in the opened state, the physical length of the first radiation section 111 is set as the electrical length of the antenna device 100. When the first switching element S1 is in the opened state, a first resonance frequency band may be set corresponding to the physical length of the first radiation section 111. When the first switching element S1 is in the closed state, the electrical length of the antenna device 100 is set by a route that passes through the first switching element S1. For example, when the first switching element S1 is in the closed state, the antenna device 100 may be operated at a second resonance which is different from the first resonance frequency.

In more detail, when the first switching element S1 is in the closed state, an electrical length, which is different from the physical length of the first radiation section 111, may be set. For example, when the switching element S1 is in the closed state, the physical length of the first radiation section 111 from the first portion P1-1 to the second portion P2-1 may not affect the resonance frequency band of the antenna device 100.

Of the switching elements S1 and S2, the second switching element S2 may include first and second terminals T1-2 and T2-2 which are respectively connected to third and fourth portions P1-2 and P2-2 of the first radiation section 111 which are different from the first and second portions P1-1 and P2-1. For example, the second switching element S2 may perform an opening/closing operation between the third and fourth sections P1-2 and P2-2. When both the first and second switching elements S1 and S2 are in the opened state, the antenna device 100 may be operated at the first resonance band which is formed by the physical length of the first radiation section 111. When the first switching element S1 is in the closed state, the second resonance frequency band of the antenna device 100 may be set by an electrical length according to a route that passes through the first switching element S1, regardless of the opened/closed state of the second switching element S2. When the first switching element S1 is in the opened state and the second switching element S2 is in the closed state, the antenna device 100 may be operated at a third resonance frequency which is set by an electrical length according to a route that passes through the second switching element S2.

When the first or second switching element S1 or S2 is in the opened state, a signal current applied to the first radiation section 111 is also distributed over the first radiation section 111 between the first, second, third, and fourth portions P1-1, P1-2, P2-1, and P2-2. Therefore, a loss caused by the resistance components of the switching elements S1 and S2 may be suppressed.

According to various embodiments of the present disclosure, the antenna device 100 may further include a second radiation section 113. The second radiation section 113 may be connected to a ground portion G as well as the power feeding unit F. The first radiation section 111 may be connected to the ground portion G via the second radiation section 113.

In the embodiment illustrated in FIG. 1, each of the first and second radiation sections 111 and 113 is exemplified as a line. However, each of the first and second radiation sections 111 and 113 may be formed in a pattern having various branch structures and designs.

Figure 2:
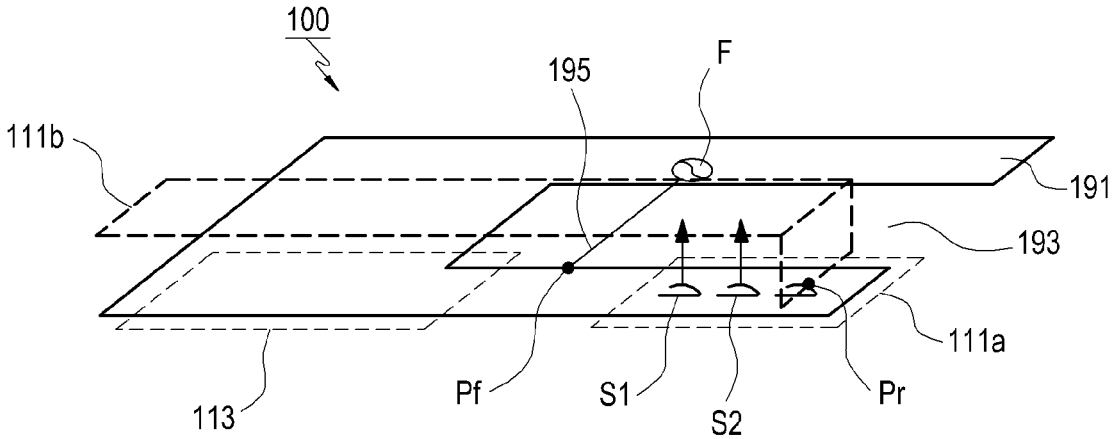
FIG. 2 is a view schematically illustrating an implementation of the antenna device illustrated in FIG. 1 according to an embodiment of the present disclosure.

FIG. 2 is a view schematically illustrating an implementation of the antenna device illustrated in FIG. 1 according to an embodiment of the present disclosure.

The shape of the antenna device or the like illustrated in FIG. 2 exemplifies an appearance obtained when the configuration illustrated in FIG. 1 is implemented and may be variously changed according to an installation space allowed by an electronic device, a resonance frequency band required by the electronic device, or the like.

Referring to FIG. 2, the antenna device 100 may include a conductive layer 191 and a radiation member 111*b* arranged on the conductive layer 191. The conductive layer 191 may be formed with a slot 193 extending from one side edge and the power feeding line 195 may be arranged across the slot 193. The power feeding unit F may be positioned at one side of the slot 193 in the conductive layer 191. The power feeding line 195 may be connected to the power feeding unit F at one side of the slot 193 and to a power feeding point Pf at the other side of the slot 193.

The radiation member 111*b* is connected to a connection point Pr so that the radiation member 111*b* may be connected to the power feeding unit F through a region 111*a* (hereinafter, referred to as a "first radiation section region") in the conductive layer 191 and the power feeding line 195. A region positioned in the conductive layer 191 in the direction toward the connection point Pr from the power feeding point Pf may be set as the first radiation section region 111*a*. The first radiation section 111 may be configured to include the radiation member 111*b* and the first radiation section region 111*a*.

The switching elements S1 and S2 may be arranged in the first radiation section region 111*a* and each of the switching elements S1 and S2 may be configured by a switch having one input route and at least one output route. For example, as for each of the switching elements S1 and S2, a Single Pole Single Throw (SPST) switch having one input route and one output route is exemplified in FIGS. 1 and 2. However, each of the switching elements may be a Single Pole Double Throw (SPDT) switch having one input route and two output routes. In addition, each of the switching elements S1 and S2 may be a switch having one input route and three or more output routes, for example, a Single Pole Quad Throw (SPQT) switch. Such switching elements may be implemented with switches using a semiconductor element. Further, such switching elements may be implemented with a Micro Electro Mechanical System (MEMS) or a tunable element such as a variable capacitor. The switching elements S1 and S2 may be arranged in the first radiation section region 111*a* to be connected to the power feeding point Pf, and the output routes of the switching element S1 and S2 may be connected to the radiation member 111*b*.

Another region positioned in the conductive layer 191 in parallel to the first radiation section region 111*a* such that the power feeding point Pf is interposed there between may be set as a second radiation section 113.

The conductive layer, i.e. the first radiation section region 111*a* may be implemented on a printed circuit board in which a signal line that supplies a power of the switching elements S1 and S2 or transmits a control signal may be embedded inside the printed circuit board. When the signal line that supplies the power or transmits the control signal is embedded, an interference between the signal line and the switching elements S1 and S2 or between the signal line and the first and second radiation sections 111*a* and 111*b* may be suppressed.

Figure 3:
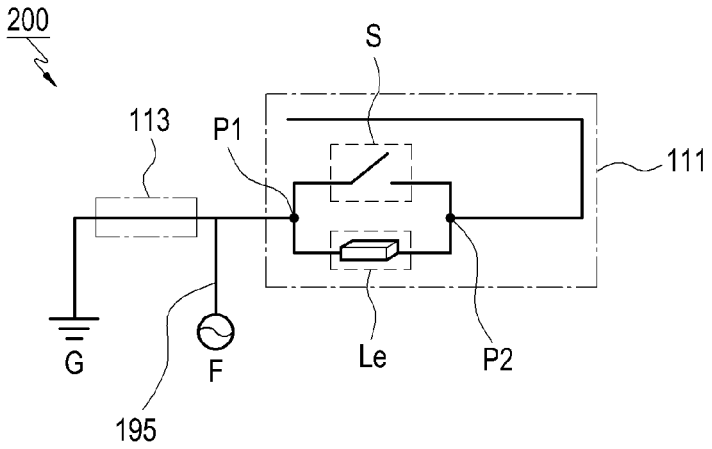
FIG. 3 is a schematic view illustrating an antenna device according to an embodiment of the present disclosure.

FIG. 3 is a view illustrating an antenna device according to an embodiment of the present disclosure.

In describing the antenna device illustrated in FIG. 3, it shall be noted that the components which may be easily understood through the descriptions of the components of the preceding embodiment may be assigned the same reference numerals and a detailed description thereof may be omitted.

Referring to FIG. 3, according to an embodiment of the present disclosure, the antenna device 200 may include a first radiation section 111 connected to a power feeding unit F, and a switching element S arranged between any one portion (hereinafter, a "first portion") P1 and another portion (hereinafter, a "second portion") P2 of the first radiation section 111. The first radiation section 111 may include a lumped element Le arranged between the first and second portions P1 and P2. The lumped element Le may include at least one of a resistive element, a capacitive element, and an inductive element. The switching element S and the lumped element Le may be arranged in parallel to each other in the first radiation section 111.

When the switching element S is in the opened state, the resonance frequency band of the antenna device 200 may be set by the physical length of the first radiation section 111 and a reactance component of the lumped element Le. When the switching element S is in the closed state, the resonance frequency band of the antenna device 200 may be set by an electrical length following a route that passes through the switching element S. A signal current applied to the first radiation section 111 is distributed over a route that passes through the lumped element Le even in a state where the switching element is in the closed state. As a result, a loss caused by the resistance component of the switching element S may be suppressed.

Figure 4:
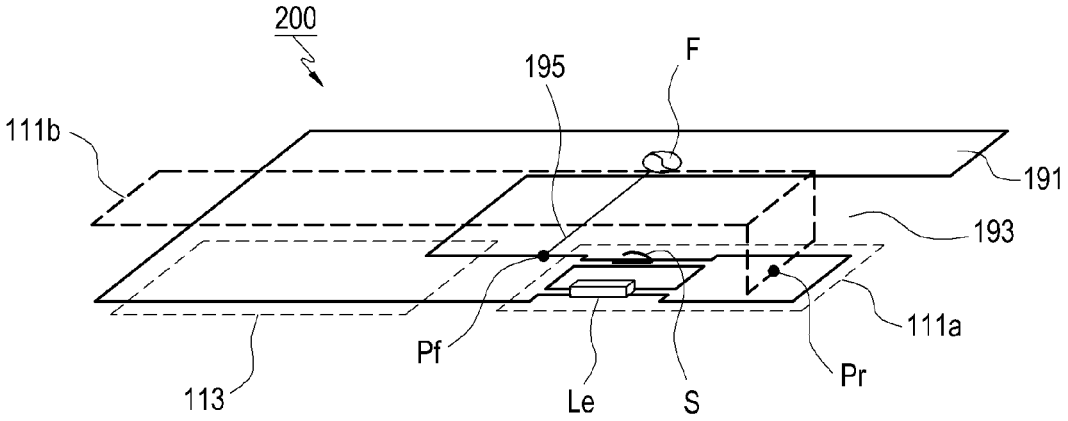
FIG. 4 is a view schematically illustrating an implementation of the antenna device illustrated in FIG. 3 according to an embodiment of the present disclosure.

FIG. 4 is a view schematically illustrating an implementation of the antenna device illustrated in FIG. 3 according to an embodiment of the present disclosure.

The shapes or the like illustrated in FIG. 4 exemplify an appearance obtained when the configuration illustrated in FIG. 3 is implemented and may be variously changed by a shape of an installation space allowed by an electronic device, a resonance frequency band required by the electronic device, or the like.

Referring to FIG. 4, the antenna device 200 may include a conductive layer 191 and a radiation member 111*b* disposed on the conductive layer 191. The conductive layer 191 may be formed with a slot 193 which extends from one side edge of the conductive layer 191 and a power feeding line 195 may be arranged across the slot 193. A power feeding unit F may be positioned at one side of the slot 193 within the conductive layer 191. The power feeding line 195 may be connected, at one side of the slot 193, to the power feeding unit F and connected, at the other side of the slot 193, to a power feeding point Pf which is provided on the conductive layer 191.

The radiation member 111*b* may be connected to a connection point Pr which is also provided on the conductive layer 191 and connected to the power feeding unit F through the first radiation section region 111*a* set by a region in the conductive layer 191 and the power feeding line 195. The switching element S and the lumped element Le may be arranged in parallel to each other between the power feeding point Pf and the connection point Pr in the first radiation section region 111*a*. The first radiation section 111 may be configured to include the radiation member 111*b* and the first radiation section region 111*a*.

Figure 5:
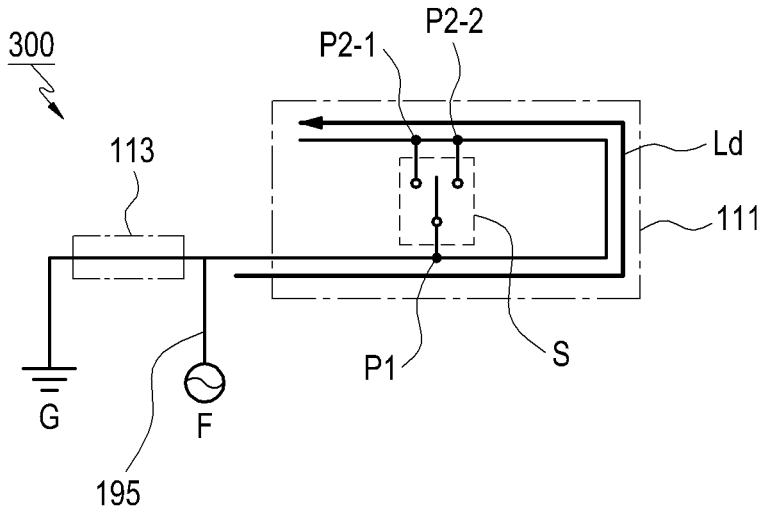
FIGS. 5 and 6 are schematic views illustrating an antenna device according to an embodiment of the present disclosure.
Figure 6:
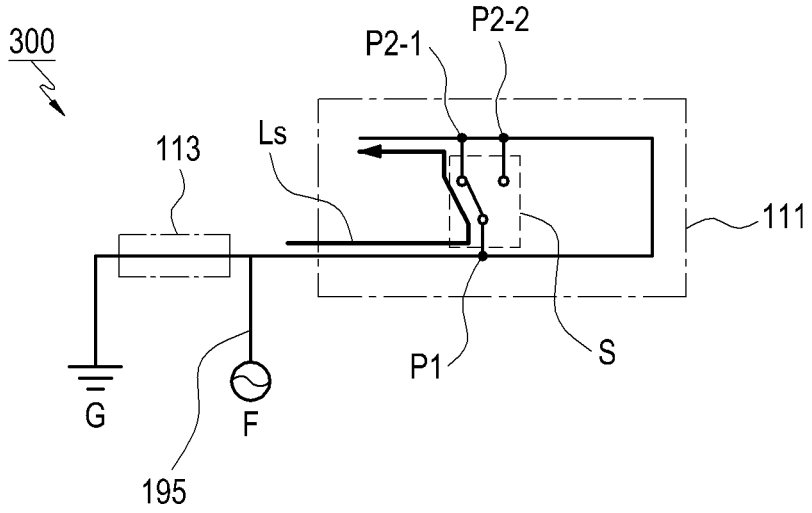

FIGS. 5 and 6 are schematic views illustrating an antenna device according to an embodiment of the present disclosure.

Referring to FIGS. 5 and 6, the antenna device 300 may be provided with a switch having one input route and a plurality of output routes, for example, an SPDT having one input route and two output routes, as a switching element S. The two output routes of the switching element S may be connected to two different second portions P2-1 and P2-2 in the first radiation section region 111*a*, respectively. The number of output routes of the switching element may be variously changed according to an embodiment.

As illustrated in FIG. 5, when the switching element S is in the opened state, the electrical length of the antenna device 300, for example, the resonance frequency band may be set by the physical length Ld of the first radiation section 111. As illustrated in FIG. 6, in a state where the switching element S is operated to connect the first portion P1 and one of the second portions P2-1 and P2-2 (e.g., the second portion P2-1) with each other, the resonance frequency band of the antenna device 300 may be set by the electrical length that follows the route connected by the switching element S. For example, the resonance frequency band of the antenna device 300 may be differently set depending on whether the switching element S is in the closed state or in the opened state or depending on the position of one of the second portions P2-1 and P2-2 connected to the first portion P1 when the switching element S is in the closed state. Even in the state where the resonance frequency band of the antenna device 300 is set by a route formed through the switching element S, the signal current is distributed over the first radiation section 111 between the first portion P1 and the second portions P2-1 and P2-2. As a result, a loss caused by the resistance component of the switching element S may be suppressed.

Figure 7:
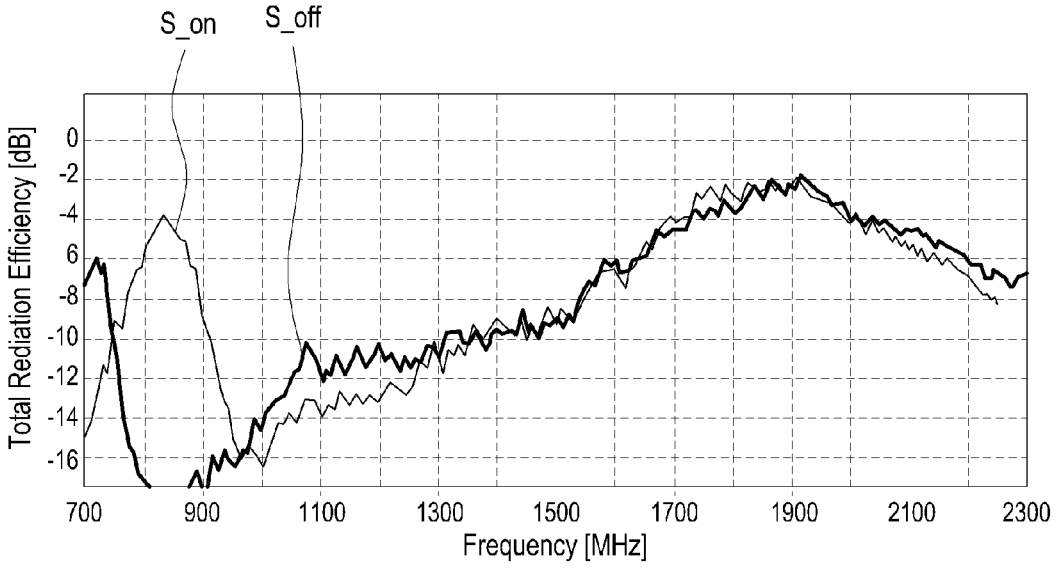
FIGS. 7 and 8 are graphs representing measured radiation characteristics of antenna devices according to various embodiments of the present disclosure.
Figure 8:
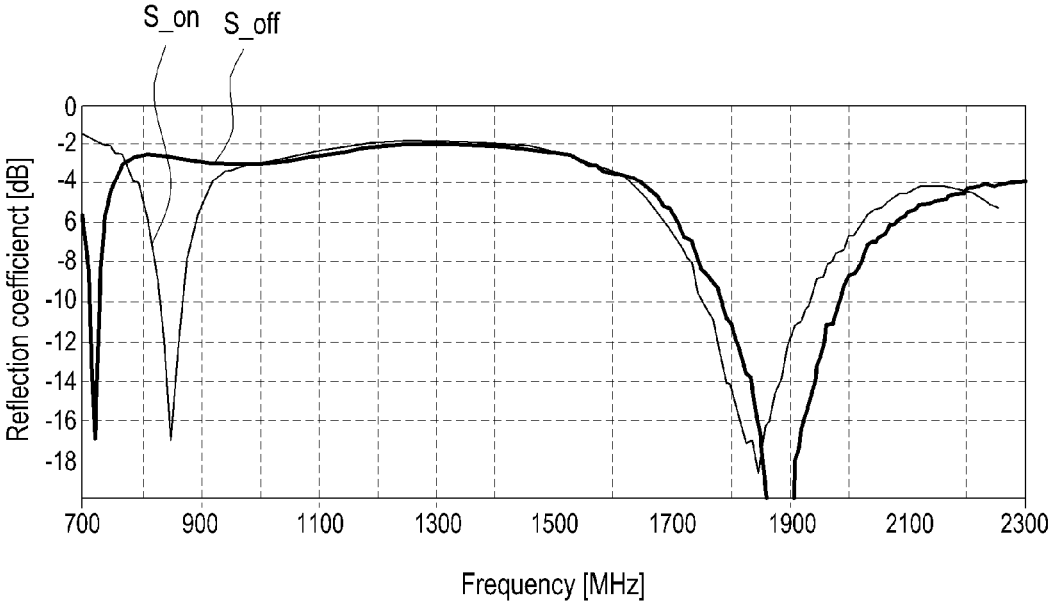

FIGS. 7 and 8 are graphs representing measured radiation characteristics of antenna devices according to various embodiments of the present disclosure.

FIG. 7 is a graph representing total radiation efficiencies of antenna devices according to embodiments of the present disclosure measured depending on a frequency band before the opening/closing operation (S_off) and a frequency band after the opening/closing operation (S_on), and FIG. 8 is a graph representing reflection coefficients of the antenna devices depending on a frequency band before the opening/closing operation (S_off) and a frequency band after the opening closing operation (S_on).

As shown in FIGS. 7 and 8, in the state where the switching element is in the closed state (S_on), a measurement was made on the antenna devices according to various embodiments of the present disclosure in which each of the antenna devices were designed to form a resonance frequency at 850 MHz and 1850 MHz. As described above, in the state where the switching element is in the opened state (S_off), the antenna devices according to various embodiments of the present disclosure may be set by the physical length of the first radiation section itself or the electrical length of the first radiation section including a lumped element.

In general, when a switching element or the like is additionally arranged in order to secure an additional resonance frequency band in the state where the resonance frequency band has been set, a considerable distortion may occur at a radiation characteristic of the previously set resonance frequency band. For example, a considerable loss occurs in the radiation section by the resistance component of the switching element. Since the antenna devices according to various embodiments of the present disclosure have a switching element arranged between a first point and a second point in the radiation section, the characteristic of the designed radiation section itself may be stably maintained. This is because the switching element is arranged in parallel to a radiation section, for example, a part of the radiation section so that the signal current may be distributed through a part of the radiation section arranged in parallel to the switching element while the electrical length of the radiation section is adjusted by the switching element.

When the switching element is switched from the closed state (S_on) to the opened state (S_off), for example, when the electrically connected state of the first portion P1-1 and the second portion P2-1 of the first radiation section 111 illustrated in FIG. 1 is changed through the switch S1, it may be seen that the resonance frequency band formed in a relatively low frequency band is shifted from 850 MHz to 700 MHz.

In general, when the resonance frequency band is adjusted using a switching element, the resistance component of the switching element may cause a loss. Accordingly, a substantial change may occur in the total radiation efficiency or a reflection coefficient profile before and after a switching element is operated in an ordinary antenna device.

As illustrated in FIGS. 7 and 8, when comparing the states before the switching element is operated (S_off) and after the switching element is operated (S_on), resonance frequency bands are changed in the antenna devices according to various embodiments of the present disclosure. However, the profiles in the graphs representing the total radiation efficiencies and the reflection coefficients may be similarly maintained. Through this, it may be seen that the antenna devices according to various embodiments of the present disclosure may prevent a loss caused by a resistance of a switching element while securing resonance frequencies of various frequency bands using the switching element. In a case where an antenna device according to various embodiments of the present disclosure is designed as an antenna that is operated at resonance frequency bands of dual bands, for example, at 850 MHz and 1850 MHz bands, it may be seen that, when any one of the resonance frequency bands is adjusted using a switching element, the antenna device may maintain a stable radiation characteristic at the other resonance frequency band.

Figure 9:
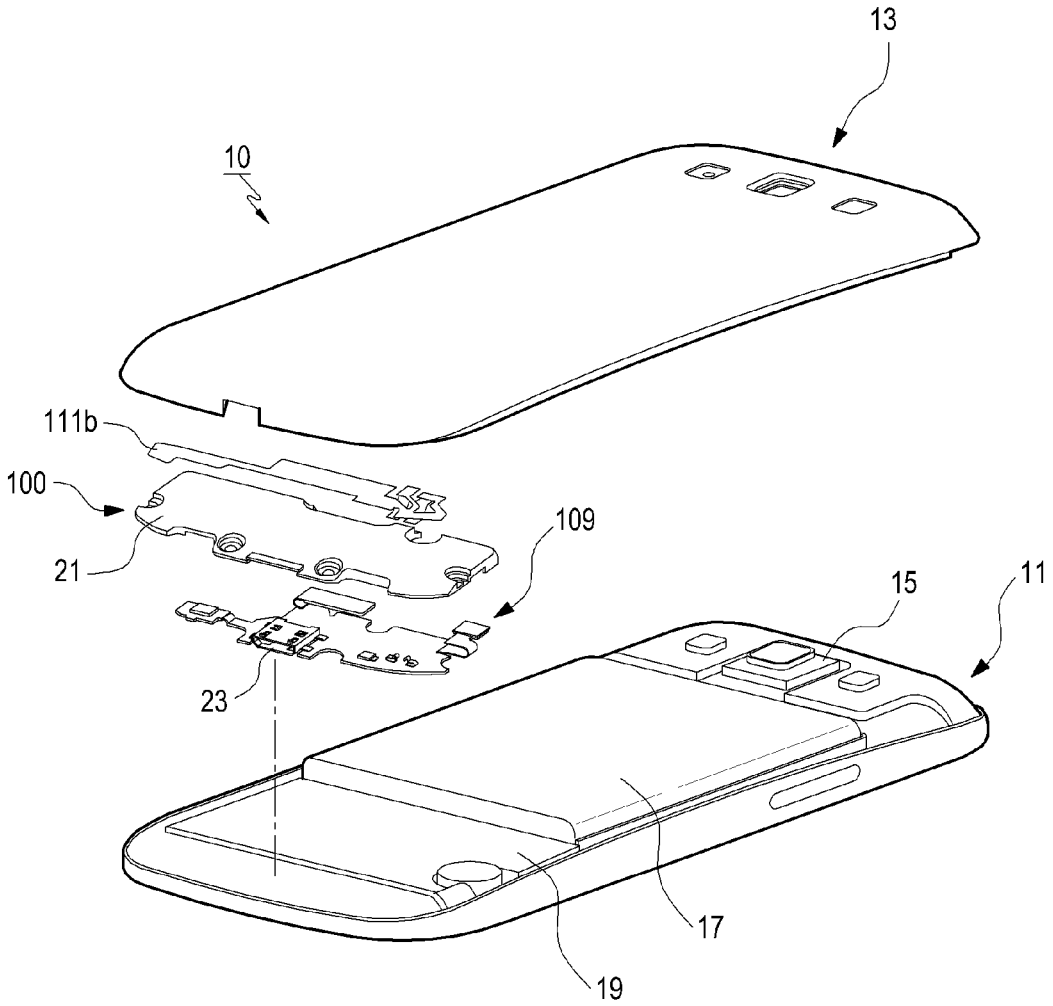
FIG. 9 is an exploded perspective view illustrating an electronic device which is provided with an antenna device according to various embodiments of the present disclosure.
Figure 10:
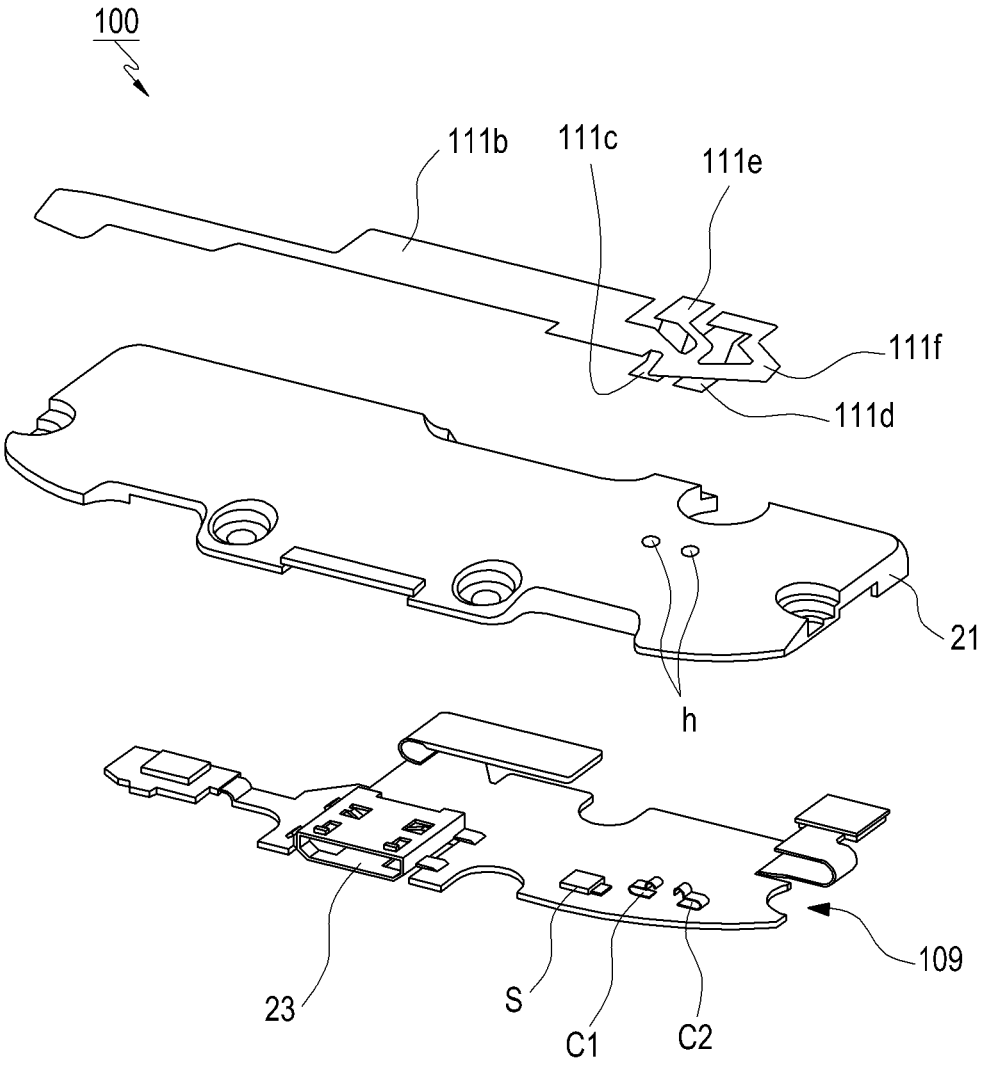
FIG. 10 is an exploded perspective view illustrating the antenna device of the electronic device illustrated in FIG. 9 according to an embodiment of the present disclosure.

FIG. 9 is an exploded perspective view illustrating an electronic device which is provided with an antenna device according to various embodiments of the present disclosure. FIG. 10 is an exploded perspective view illustrating the antenna device of the electronic device illustrated in FIG. 9 according to an embodiment of the present disclosure.

An electronic device according to various embodiments of the present disclosure may be any device including a communication function. For example, the electronic device may include at least one of a smart phone, a tablet Personal Computer (PC), a mobile phone, a video telephone, an e-book reader, a desktop PC, a laptop PC, a netbook computer, a Personal Digital Assistant (PDA), a Portable Multimedia Player (PMP), an MP3 player, a mobile medical appliance, a camera, a game machine, a wearable device (e.g., a Head-Mounted-Device (HMD) such as electronic glasses, electronic clothing, an electronic bracelet, an electronic necklace, an electronic appcessory, an electronic tattoo, a smart watch, etc.) and the like.

According to various embodiments, the electronic device may be a smart home appliance with a communication function. For example, the smart home appliance may include at least one of a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, an electronic photo frame, and the like.

According to various embodiments, the electronic device may include at least one of various types of medical devices (for example, Magnetic Resonance Angiography (MRA), Magnetic Resonance Imaging (MRI), Computed Tomography (CT), a scanning machine, ultrasonic wave device, and the like), a navigation device, a Global Positioning System (GPS) receiver, an Event Data Recorder (EDR), a Flight Data Recorder (FDR), a car infotainment device, ship electronic equipment (for example, navigation equipment for a ship, a gyro compass and the like), avionics, a security device, an industrial or home robot, and the like.

According to various embodiments, the electronic device may include at least one of furniture or a part of a building/structure having a communication function, an electronic board, an electronic signature receiving device, a projector, various measuring equipment (e.g., a water meter, an electricity meter, a gas meter, radio wave measuring equipment, etc.), and the like. The electronic device according to various embodiments of the present disclosure may be a combination of one or more of the above-mentioned various devices. Further, it will be apparent to those skilled in the art that the electronic device according to the present disclosure is not limited to the above-mentioned devices.

In describing the configurations illustrated in FIGS. 9 and 10, FIGS. 1 and 2 will also be referred to, but it is assumed that only one switching element is provided in the configuration.

Referring to FIGS. 9 and 10, the electronic device 10 may include a battery pack 17 which is detachably provided on the rear surface of the housing 11, a camera module 15 disposed at one side of the region where the battery pack 17 is mounted, and a main circuit board 19 disposed at the other side of the region where the battery pack 17 is mounted. In addition, the electronic device 10 is provided with a cover member 13 coupled to the rear side of the housing 11 so as to protect the battery pack 17 or the like.

The antenna device 100 may be arranged adjacent to the main circuit board 19.

The antenna device 100 may include an auxiliary circuit board 109 and a carrier 21 in which the auxiliary circuit board 109 may be formed by a part of the main circuit board 19. A connector member 23 is mounted on the auxiliary circuit board 109 so as to provide a connection means between the electronic device 10 and an external device such as a charger. The auxiliary circuit board 109 and the carrier 21 may be used as a structure where the constituent elements of the antenna device as described above may be installed.

The auxiliary circuit board 109 may be made of a multi-layered circuit board and a conductive layer 191 as described above may be arranged on one of the layers of the auxiliary circuit board 109. The conductive layer 191 is illustrated in a form of a plate in FIG. 2. However, the conductive layer 191 may be practically implemented in the auxiliary circuit board 109 as a printed circuit pattern that connects various routes.

A switching element S as described above and at least one pair of connection terminals C1 and C2 may be arranged on the auxiliary circuit board 109. Of the connection terminals C1 and C2, the first connection terminal C1 is connected to a power feeding line 195 and a power feeding unit F through the switching element S and the second connection terminal C2 may be directly connected to the power feeding line. It shall be noted that, since either the power feeding line 195 or the power feeding unit F is configured by a printed circuit pattern or an electronic circuit chip on the auxiliary circuit board 109 or the main circuit board 19, the reference numerals thereof are omitted in FIGS. 9 and 10.

A radiation member 111*b* is arranged on the carrier 21. The radiation member 111*b* may be attached to or formed in various forms of patterns on the top surface of the carrier 21. When the radiation member 111*b* includes extensions 111*e* and 111*f*, a route connected to the auxiliary circuit board 109 may be provided. A plurality of connection pads 111*c* and 111*d* may be arranged on the bottom surface of the carrier 21. Of the connection pads 111*c* and 111*d*, the first connection pad 111*c* and the second connection pad 111*d* may be connected to the first extension 111*e* and the second extension 111*f* of the radiation member 111*b*, respectively. The first and second connection pads 111*c* and 111*d* may be configured by the first and second extensions 111*e* and 111*f* which extend to the bottom surface through a side surface of the carrier 21. In another embodiment, the radiation member 111*b* may extend to the inner surface of the carrier 21 to be arranged to face or be contacted with the connector member 23. The connector member 23 may contain a metal of a conductive material so as to provide a ground portion or the like. The conductive material portion of the connector member 23 may be connected to the radiation member 111*b* to be used as a portion of the radiation member 111*b*.

In an embodiment, the first and second connection pads 111*c* and 111*d* may be configured separately from the first and second extensions 111*e* and 111*f*. When the first and second connection pads 111*c* and 111*d* are formed separately from the first and second extensions 111*e* and 111*f*, the first and second connection pads 111*c* and 111*d* may be electrically connected to the first and second extensions 111*e* and 111*f*, respectively, through via holes h that penetrate the carrier 21.

When the auxiliary circuit board 109 and the carrier 21 are mounted within the housing 11, the first and second connection pads 111*c* and 111*d* come in contact with the first and second connection terminals C1 and C2, respectively. When the first and second connection terminals C1 and C2 have a structure such as a C-clip that may accumulate an elastic force, the first and second connection terminals C1 and C2 may maintain a stable contact state with the first and second connection pads 111*c* and 111*d*. Here, the radiation member 111*b*, the first and second extensions 111*e* and 111*f*, the first and second connection pads 111*c* and 111*d*, the first and second connection terminals C1 and C2, and a part of the conductive layer 191 of the auxiliary circuit board 109 may form the first radiation section 111. In addition, the switching element S is connected to the radiation member 111*b* through the first connection terminal 111*c* when the switching element S is mounted on the auxiliary circuit board 109 so as to connect any one portion and another portion in the first radiation section 111 to one another.

A separate signal line may be formed on a circuit board that transmits a control signal to the switching element S, for example, the auxiliary circuit board 109. Since the auxiliary circuit board S is implemented with a multi-layered circuit board, the signal line may be formed on a layer which is different from that of the switching element S. When the signal line that transmits the control signal is formed on the different layer, electric interference between the switching element S and the signal line, or between the first radiation section 111 and the signal line may be prevented.

When the switching element S is in the opened state, the electrical length of the antenna device 100 may be set through a route formed by connecting the second connection terminal C2, the second connection pad 111*d*, and the second extension 111*f*. Regardless of whether the switching element S in the closed state or in the opened state, the route formed by the second connection terminal C2, the second connection pad 111*d* and the second extension 111*f* may be maintained in the electrically connected state. When the switching element S is in the closed state, the electrical length of the antenna device 100 may be set through a route formed by connecting the switching element S, the first connection terminal 111*c*, the first connection pad 111*c*, and the first extension 111*e*. Accordingly, the electrical length of the antenna device 100 may be differently set depending on whether the switching element S is in the closed state or in the opened state.

When the switching element S is in the closed state, the electrical length of the antenna device 100 is set through a route that passes through the switching element S. However, the signal current applied to the first radiation section 111 may be distributed over a route formed by connecting the second connection terminal C2, the second connection pad 111*d*, and the second extension 111*f*. Accordingly, it is possible to prevent the resistance component of the switching element S from deteriorating the radiation characteristic of the antenna device 100.

Figure 11:
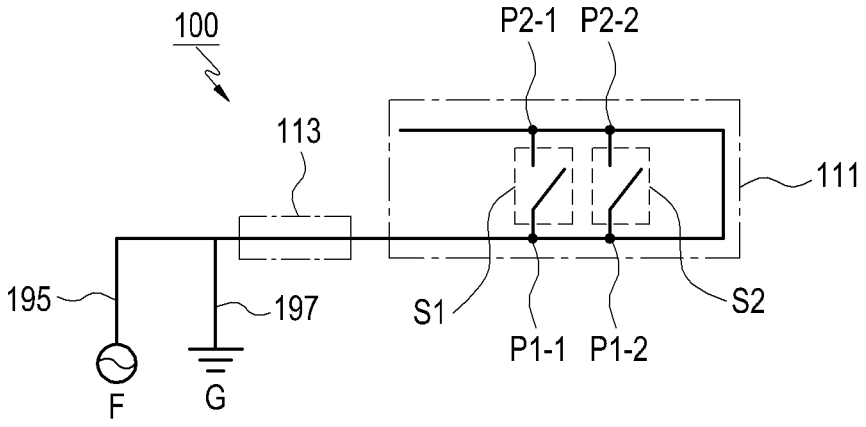
FIG. 11 is a schematic view illustrating a modified example of a power feeding structure of an antenna device according to various embodiments of the present disclosure.
Figure 12:
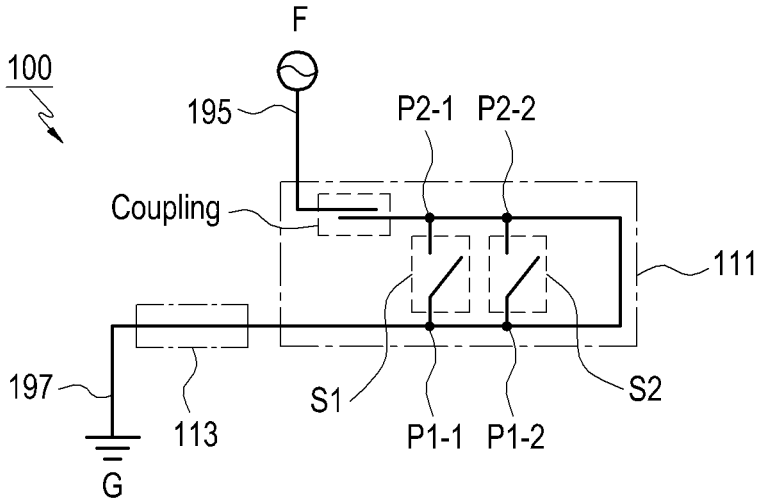
FIG. 12 a schematic view illustrating a modified example of a power feeding structure of an antenna device according to various embodiments of the present disclosure.

FIGS. 11 and 12 are schematic views illustrating modified examples of power feeding structures of an antenna device according to various embodiments of the present disclosure.

In an embodiment as described above, although it has been exemplified that a second radiation section is provided between a power feeding unit and a ground portion and a first radiation section is connected to the ground portion via the second radiation section, the present disclosure is not limited thereto.

Referring to FIG. 11, a ground line 197 connected to a ground portion G may be branched between a power feeding unit F and a first radiation section 111. A second radiation section 113 may be arranged between the first radiation section 111 and the ground portion G or between the first radiation section 111 and the ground line 197. Accordingly, the first radiation section 111 may be connected to each of the ground portion G and the power feeding unit F via the second radiation section 113.

Referring to FIG. 12, the antenna device may be implemented in an indirect power feeding type such as an electromagnetic coupling type. As illustrated in FIG. 12, a part of the power feeding line 195 extending from the power feeding unit F may be positioned adjacent to a part of the first radiation section 111. For example, when an end of the power feeding line 195 is be positioned adjacent to an end of the first radiation section 111 to form an electromagnetic coupling, the first radiation section may be connected to the power feeding unit F so as to be fed with power.

Although the examples illustrated in FIGS. 11 and 12 exemplify configurations obtained by modifying the power feeding structure of the antenna device illustrated in FIG. 1, the power feeding structures may also be used in another type of an antenna device, for example, as a power feeding structure for the antenna device illustrated in FIG. 3 or FIG. 5.

Figure 13:
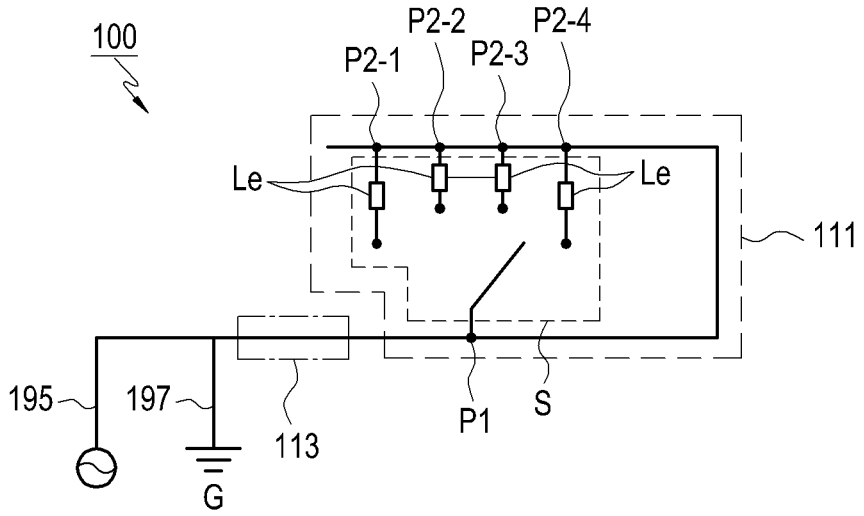
FIG. 13 is a schematic view illustrating an antenna device according to an embodiment of the present disclosure.

FIG. 13 is a schematic view illustrating an antenna device according to an embodiment of the present disclosure.

Referring to FIG. 13, the antenna device 100 may include an SPQT switch as a switching element. The switching element S may include a matching circuit in each output route for impedance matching. The matching element may be constituted with a lumped element Le, for example, one of a resistive element, a capacitive element, and an inductive element, or a combination thereof. In addition, the output routes of the switching elements S may be provided with different matching circuits, respectively, according to electric characteristics thereof.

Figure 14:
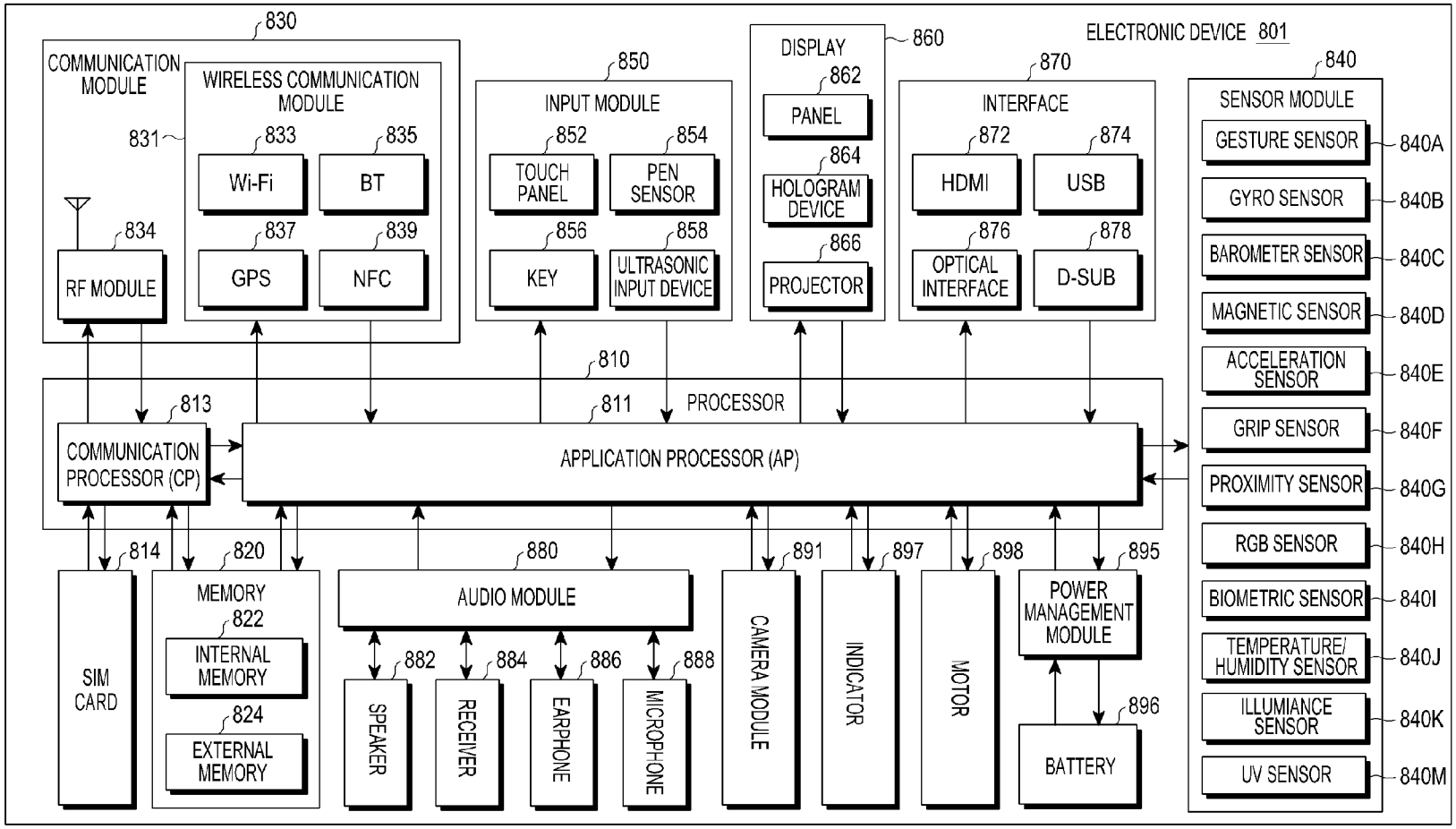
FIG. 14 is a block diagram illustrating a structure of an electronic device according to various embodiments of the present disclosure.

FIG. 14 illustrates a structure of an electronic device according to various embodiments of the present disclosure.

Referring to FIG. 14, an electronic device 801 may include at least one processor 810, a Subscriber Identification Module (SIM) card 814, a memory 820, a communication module 830, a sensor module 840, an input module 850, a display 860, an interface 870, an audio module 880, a camera module 891, a power management module 895, a battery 896, an indicator 897, and/or a motor 898. The electronic device 801 may constitute, for example, all or a part of the electronic device 10 shown in FIG. 9.

The processor 810 may include one or more Application Processor (AP) 811 or one or more Communication Processor (CP) 813. Although the AP 811 and the CP 813 are included in the processor 810 in FIG. 14, the AP 811 and the CP 813 may be included in different IC packages respectively. According to an embodiment, the AP 811 and the CP 813 may be included in one IC package.

The AP 811 may control a plurality of hardware or software components connected to the AP 811 by driving an operating system or an application program and process various data including multimedia data and perform calculations. The AP 811 may be implemented as, for example, a System on Chip (SoC). According to an embodiment, the processor 810 may further include a Graphic Processing Unit (GPU).

The CP 813 may perform a function of managing data links and converting communication protocols in communication between an electronic device (e.g., the electronic device 10) and other electronic devices connected with the electronic device through a network. The CP 813 may be implemented as, for example, a SoC. According to an embodiment, the CP 813 may perform at least a part of multimedia control functions. The CP 813 may perform identification and authentication of an electronic device in communication networks by using, for example, Subscriber Identification Modules (for example, the SIM card 814). Further, the CP 813 may provide a user with services, such as a voice call, a video call, a text message, packet data, or the like.

In addition, the CP 813 may control data transmission/reception of the communication module 830. Although component elements such as the CP 813, the power management module 895, the memory 820, or the like are illustrated as separate elements from the AP 811 in FIG. 14, the AP 811 may be implemented to include at least some (for example, the CP 813) of the above-described elements according to an embodiment of the present disclosure.

According to an embodiment, the AP 811 or the CP 813 may load, to a volatile memory, commands or data received from at least one of a non-volatile memory or other component elements which are connected with the AP 211 and the CP 213, and process the same. In addition, the AP 811 or the CP 813 may store, in a non-volatile memory, data that is received from or generated by at least one of the component elements.

The SIM card 814 may be a card including a subscriber identification module and may be inserted into a slot formed in a particular portion of the electronic device. The SIM card 814 may include unique identification information (for example, an Integrated Circuit Card IDentifier (ICCID)) or subscriber information (for example, International Mobile Subscriber Identity (IMSI)).

The memory 820 may include an internal memory 822 or an external memory 824. The internal memory 822 may include, for example, at least one of a volatile memory (e.g., a Dynamic RAM (DRAM), a Static RAM (SRAM), a Synchronous Dynamic RAM (SDRAM), and the like), and a non-volatile Memory (e.g., a One Time Programmable ROM (OTPROM), a Programmable ROM (PROM), an Erasable and Programmable ROM (EPROM), an Electrically Erasable and Programmable ROM (EEPROM), a mask ROM, a flash ROM, a NAND flash memory, an NOR flash memory, and the like). According to an embodiment, the internal memory 822 may be a Solid State Drive (SSD). The external memory 824 may further include a flash drive, for example, a Compact Flash (CF), a Secure Digital (SD), a Micro Secure Digital (Micro-SD), a Mini Secure Digital (Mini-SD), an extreme Digital (xD), a memory stick or the like. The external memory 824 may be functionally connected to the electronic device 801 through various interfaces. According to an embodiment, the electronic device 801 may further include a storage device (or storage medium) such as a hard drive.

The communication module 830 may include a wireless communication module 831 or a Radio Frequency (RF) module 834. The wireless communication module 831 may include, for example, WiFi 833, BlueTooth (BT) 835, a Global Positioning System (GPS) 837, or a Near Field Communication (NFC) 839. For example, the wireless communication module 831 may provide a wireless communication function by using a wireless frequency. Additionally or alternatively, the wireless communication module 831 may include a network interface (e.g., a LAN card) or a modem for connecting the electronic device 801 with a network (e.g., the Internet, a Local Area Network (LAN), a Wire Area Network (WAN), a telecommunication network, a cellular network, a satellite network, a Plain Old Telephone Service (POTS), or the like).

The RF module 834 may be responsible for transmitting/receiving data, for example, an RF signal. Although not illustrated, the RF module 834 may include, for example, a transceiver, a Power Amp Module (PAM), a frequency filter, a Low Noise Amplifier (LNA), or the like. Further, the RF unit 834 may further include a component for transmitting/receiving an electromagnetic wave in the air in radio communication, such as a conductor or a conducting wire.

The sensor module 840 may measure a physical quantity or detect an operation status of the electronic device 801, and convert the measured or detected information to an electronic signal. The sensor module 840 may include, for example, at least one of a gesture sensor 840A, a gyro sensor 840B, an atmospheric pressure sensor 840C (e.g., a barometer sensor), a magnetic sensor 840D, an acceleration sensor 840E, a grip sensor 840F, a proximity sensor 840G, a color sensor 840H (for example, Red, Green, and Blue (RGB) sensor), a biometric sensor 840I, a temperature/humidity sensor 840J, an illumination sensor 840K, and an Ultra Violet (UV) sensor 840M. Additionally or alternatively, the sensor module 840 may include, for example, an E-nose sensor (not illustrated), an ElectroMyoGraphy (EMG) sensor (not illustrated), an ElectroEncephaloGram (EEG) sensor (not illustrated), an ElectroCardioGram (ECG) sensor (not illustrated), an InfraRed (IR) sensor, an iris sensor (not illustrated), a fingerprint sensor, and the like. The sensor module 840 may further include a control circuit for controlling one or more sensors included in the sensor module 840.

The input module 850 may include a touch panel 852, a (digital) pen sensor 854, a key 856, and/or an ultrasonic input device 858. The touch panel 852 may recognize a touch input through at least one of, for example, a capacitive type, a resistive type, an infrared type, and an acoustic wave type. The touch panel 852 may further include a control circuit. In the capacitive type, a physical contact or proximity recognition is possible. The touch panel 852 may also further include a tactile layer. In this case, the touch panel 852 may provide a tactile reaction to the user.

The (digital) pen sensor 854 may be implemented, for example, using a method identical or similar to a method of receiving a touch input of a user or using a separate recognition sheet. The key 856 may include, for example, a physical button, an optical key, a keypad, a touch key, and the like. The ultrasonic input device 858 is a device which can detect an acoustic wave by a microphone (for example, a microphone 888) in the electronic device through an input tool generating an ultrasonic signal to identify data, and allows for wireless recognition. According to an embodiment, the electronic device 801 may receive a user input from an external device (for example, network, computer, server, etc.) connected to the electronic device 801 by using the communication module 830.

The display 860 may include a panel 862, a hologram device 864, or a projector 866. The panel 862 may be, for example, a Liquid Crystal Display (LCD), an Active-Matrix Organic Light Emitting Diode (AM-OLED), or the like. The panel 862 may be implemented to be, for example, flexible, transparent, wearable, or the like. The panel 862 and the touch panel 852 may be integrated into one module. The hologram 864 may display 3D images in the air by using the interference phenomenon of light. The projector 866 may project light on a screen to display an image. For example, the screen may be located inside or outside the electronic device 801. According to an embodiment, the display 860 may further include a control circuit for controlling the panel 862, the hologram device 864, or the projector 866.

The interface 870 may include, for example, a High-Definition Multimedia Interface (HDMI) 872, a Universal Serial Bus (USB) 874, an optical interface (e.g., communication terminal) 876, or a D-subminiature (D-sub) 878. Additionally or alternatively, the interface 870 may include, for example, a Mobile High-definition Link (MHL) interface (not shown), an SD/Multi-Media Card (MMC) interface (not shown), or an Infrared Data Association (IrDA) standard interface (not shown).

The audio module 880 may bi-directionally convert a sound and an electronic signal. The audio module 880 may process sound information input or output through, for example, a speaker 882, a receiver 884, an earphone 886, the microphone 888, or the like.

The camera module 891 is a device for capturing a still or moving image, and according to an embodiment, may include one or more image sensors (e.g., a front sensor or a rear sensor), a lens (not shown), an Image Signal Processor (ISP) (not shown), a flash (not shown) (e.g., an LED or xenon lamp), and the like.

The power management module 895 may manage power of the electronic device 801. Although not illustrated, the power management module 895 may include, for example, a Power Management Integrated Circuit (PMIC), a charger Integrated Circuit (IC), or a battery or fuel gauge.

The PMIC may be mounted within, for example, an integrated circuit or an SoC semiconductor. Charging methods may be classified into a wired charging method and a wireless charging method. The charger IC may charge a battery and prevent overvoltage or overcurrent from flowing from a charger. According to an embodiment, the charger IC may include a charger IC for at least one of the wired charging method and the wireless charging method. Examples of the wireless charging method include a magnetic resonance type, a magnetic induction type, and an electromagnetic wave type, and additional circuits for wireless charging, such as a coil loop circuit, a resonance circuit, and a rectifier circuit, may be added.

The battery gauge may measure, for example, the residual capacity, charge in voltage, current, or temperature of the battery 896. The battery 896 may store or generate electricity, and may supply power to the electronic device 801 by using the stored or generated electricity. The battery 896 may include, for example, a rechargeable battery or a solar battery.

The indicator 897 may display a specific status of the electronic device 801 or a part (for example, the AP 811) thereof, for example, a boot-up status, a message status, or a charging status. The motor 898 may convert an electrical signal into a mechanical vibration. Although not shown, the electronic device 801 may include a processing unit (for example, GPU) for supporting a mobile TV function. The processing unit for supporting a mobile TV function may process media data pursuant to a certain standard, for example, Digital Multimedia Broadcasting (DMB), Digital Video Broadcasting (DVB), or media flow.

Each of the above described elements of the electronic device according to the present disclosure may be implemented by one or more components and the name of the corresponding element may vary depending on the type of the electronic device. The electronic device according to the present disclosure may include at least one of the above-mentioned elements or may further include other additional elements, or some of the above-mentioned elements may be omitted. Further, some of the elements of the electronic device according to the present disclosure may be coupled to form a single entity while performing the same functions as those of the corresponding elements before the coupling.

For example, in configuring an antenna device according to various embodiments, members of a conductive material provided in an electronic device, for example, a shield member that forms the connector member 23 illustrated in FIG. 10 may be electrically connected to at least one of the first and second radiation sections 111 and 113. In addition, the members of the conductive material connected to the first or second radiation section 111 or 113 may form a part of the radiation section of the antenna device according to various embodiments. Further, the members of the conductive material may include an ornamental member of the conductive material which is arranged together with a home key or a side key, or an ornamental member arranged in a camera module, a sound output hole, or the like.

Various embodiments of the present disclosure exemplify the configurations in which the antenna devices have a resonance frequency band of a low frequency band which is formed at an 850 MHz (700 MHz) band and a resonance frequency of a high frequency band which is formed at an 1850 MHz band. However, the resonance frequency bands may be formed at different frequency bands depending on the kinds or shapes of the radiation members. In addition, although various embodiments of the present disclosure exemplify the configurations in which the resonance frequency bands of the antenna devices are formed in dual bands, more resonance frequency bands may be variously secured depending on a pattern design of the radiation members.

Further, in the antenna devices according to various embodiments of the present disclosure, the configurations and the numbers of extensions extending from a radiation member, connection pads electrically connected with the extensions, connection terminals provided on a circuit board, etc. may be set to be different from those described in the above depending on the number of switching elements or the number of output routes of the switching elements.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a processor; and an antenna device, wherein the antenna device includes:

a conductive layer formed with a slot, a power feeding unit, a power feeding line arranged across the slot while being connected to the power feeding unit at one side of the slot and to a power feeding point provided in the conductive layer at another side of the slot, a radiation member arranged on the conductive layer and connected to the conductive layer at a connection point which is different from the power feeding point, a first radiation section having one end physically connected to the power feeding unit and configured to include the radiation member and a region in the conductive layer between the power feeding point and the connection point, and a first switching element arranged in the region in the conductive layer between the power feeding point and the connection point and including a first terminal electrically connected to a first portion of the first radiation section, and a second terminal electrically connected to a second portion of the first radiation section, wherein the first portion of the first radiation section and the second portion of the first radiation section are disposed between the one end of the first radiation section and another end of the first radiation section, and wherein the processor is configured to:

operate in a first resonance frequency band set corresponding to the physical length of the first radiation section when the first switching element is opened, and operate in a second resonance frequency band set by a route formed through the first switching element which is different from the first resonance frequency band while simultaneously distributing a signal current from the power feeding unit over the physical length of the first radiation section when the first switching element is closed.

2. The electronic device of claim 1, wherein the antenna device further includes a second switching element which includes another first terminal and another second terminal which are connected to a third portion and a fourth portion in the first radiation section, respectively, and wherein the third and fourth portions are different from the first and second portions.

3. The electronic device of claim 1, wherein the antenna device further includes:

a ground portion, and a second radiation section connected to the ground portion and connected to the power feeding unit, and wherein the first radiation section is connected to the ground portion via the second radiation section.

4. The electronic device of claim 1, wherein the antenna device further includes: a ground line branched between the power feeding unit and the first radiation section, a ground portion connected to the ground line, and a second radiation section arranged between the ground line and the first radiation section, and wherein the first radiation section is connected to the power feeding unit via the second radiation section.

5. The electronic device of claim 1, wherein the antenna device further includes:

a power feeding line extending from the power feeding unit, and wherein a part of the power feeding line is disposed adjacent to a part of the first radiation section.

6. The electronic device of claim 5, wherein an end portion of the power feeding line and an end portion of the first radiation section are arranged adjacent to each other to form an electromagnetic coupling.

7. The electronic device of claim 1, wherein the first switching element includes one input route and a plurality of output routes, and wherein the output routes are respectively connected to second portions which are different from each other.

8. The electronic device of claim 7, wherein the antenna device further includes:

an impedance matching element or an impedance matching circuit provided at at least one of the output routes.

* * * * *